US006688390B2

(12) United States Patent
Bolze et al.

(10) Patent No.: US 6,688,390 B2
(45) **Date of Patent: *Feb. 10, 2004**

(54) FORMATION FLUID SAMPLING APPARATUS AND METHOD

(75) Inventors: Victor M. Bolze, Houston, TX (US); Jonathan W. Brown, Alford (GB); Andrew L. Kurkjian, Sugar Land, TX (US); Timothy L. Long, Alvin, TX (US); Angus J. Melbourne, Montrouge Cedex (FR); Linward A. Moore, Stafford, TX (US); Robert P. Zimmerman, Friendswood, TX (US)

(73) Assignee: Schlumberger Technology Corporation, Sugar Land, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/511,183

(22) Filed: Feb. 22, 2000

(65) Prior Publication Data

US 2002/0060067 A1 May 23, 2002

Related U.S. Application Data

(60) Provisional application No. 60/126,088, filed on Mar. 25, 1999.

(51) Int. Cl.[7] ..... E21B 49/00; E21B 49/08

(52) U.S. Cl. ..... 166/264; 166/167; 175/59

(58) Field of Search ..... 166/163, 165, 166/167, 264; 175/20, 58, 59

(56) References Cited

U.S. PATENT DOCUMENTS 4,633,952 A * 1/1987 Ringgenberg ..... 166/336

(List continued on next page.)

FOREIGN PATENT DOCUMENTS

GB 2288618 A 10/1995
GB 2 288 618 A 10/1995

OTHER PUBLICATIONS

Search Report from U.K. Patent Office (May 22, 2000).

(List continued on next page.)

*Primary Examiner*—David Bagnell
*Assistant Examiner*—Jennifer H Gay
(74) *Attorney, Agent, or Firm*—J. L. Jennie Salazar; Brigitte L. Jeffery; John Ryberg

(57) ABSTRACT

A sample module is provided for use in a downhole tool to obtain fluid from a subsurface formation penetrated by a wellbore. The sample module includes a sample chamber carried by the module for collecting a sample of formation fluid obtained from the formation via the downhole tool, and a validation chamber carried by the module for collecting a substantially smaller sample of formation fluid than the sample chamber. The validation chamber is removable from the sample module at the surface without disturbing the sample chamber. A sample chamber is also provided that includes a subtantially cylindrical body capable of safely withstanding heating at the surface, following collection of a formation fluid sample via the downhole tool and withdrawal of the sample chamber from the wellbore, to temperatures necessary to promote recombination of the sample components wihtin the chambers. Additionally, the body is equipped so as to be certified for transportation. At least one floating piston is slidably positioned within the body so as to define a fluid collection cavity and a pressurization cavity, whereby the pressurization cavity may be charged to control the pressure of the sample collected in the collection cavity. A second such piston may be provided to create a third cavity wherein a buffer fluid may be utilized during sample collection. Metal-to-metal seals act as the final shut-off seals for the sample collected in the collection cavity of the body. A method related to the use of the sample module and sample chamber described above is also provided.

31 Claims, 13 Drawing Sheets

U.S. PATENT DOCUMENTS 4,856,585 A * 8/1989 White et al. ..... 166/250
4,860,581 A 8/1989 Zimmerman et al.
4,936,139 A 6/1990 Zimmerman et al.
4,940,088 A 7/1990 Goldschild
4,994,671 A 2/1991 Safinya et al.
5,166,747 A 11/1992 Schroeder et al.
5,269,180 A 12/1993 Dave et al.
5,303,775 A 4/1994 Michaels et al.
5,337,822 A 8/1994 Massie et al.
5,377,755 A 1/1995 Michaels et al.
5,609,205 A 3/1997 Massie et al.
5,708,220 A 1/1998 Burge
5,901,788 A 5/1999 Brown et al.
5,934,374 A 8/1999 Hrametz et al.
5,939,717 A 8/1999 Mullins
5,956,132 A 9/1999 Donzier

OTHER PUBLICATIONS

Baker Hughes/Baker Atlas brochure, "Reservoir Characterization Instrument", 1997, Western Atlas International.

Halliburton brochure, "Reservoir Description Tool (RDT ™)", 1999, Halliburton Energy Services.

Deruyck, Bruno et al., Fluid PVT Sampling with Wireline Testers in West Africa—Experience and Examples, Offshore West Africa 1996 Conference and Exhibition, Libreville, Gabon, Nov. 5–7, 1996, pp. 1–14.

* cited by examiner

SM
54
162
160
110
122
156
123
124
146
150
112
124v
148
54a

SM
162
164
160
166
158
120
156
121
123
124
124v
112
148
146
150
54a

SM
122
156
123
124
124v
148
146
150
54a

SM
162
158
148
54a

FORMATION FLUID SAMPLING APPARATUS AND METHOD

CROSS-REFERENCE TO RELATED APPLICATION

This application is a U.S. Provisional Patent Application Serial No. 60/126,088 filed on Mar. 25, 1999.

BACKGROUND OF THE INVENTION

1. Field of the Invention

This invention relates generally to formation fluid sampling, and more specifically to an improved reservoir fluid sampling module, the purpose of which is to bring high quality reservoir fluid samples to the surface for analysis.

2. The Related Art

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a sampling tool, such as the MDT™ formation testing tool, owned and provided by Schlumberger, into the wellbore to collect a sample or multiple samples of formation fluid by engagement between a probe member of the sampling tool and the wall of the wellbore. The sampling tool creates a pressure differential across such engagement to induce formation fluid flow into one or more sample chambers within the sampling tool. This and similar processes are described in U.S. Pat. Nos. 4,860,581; 4,936,139 (both assigned to Schlumberger); U.S. Pat. Nos. 5,303,775; 5,377,755 (both assigned to Western Atlas); and U.S. Pat. No. 5,934,374 (assigned to Halliburton).

The desirability of housing at least one, and often a plurality, of such sample chambers, with associated valving and flow line connections, within "sample modules" is also known, and has been utilized to particular advantage in Schlumberger's MDT tool. Schlumberger currently has several types of such sample modules and sample chambers, each of which provide certain advantages for certain conditions. None of these sample module/chamber combinations, however, exhibit all the characteristics of: permitting a gas charge behind the collected sample for better pressure management of the sample; being heatable up to 400° F. at internal pressures up to 25,000 psi to promote the sample fluid components to go back into solution; being sized and certified for transportation directly from the well site to the laboratory without a need to transfer the collected sample; and being equipped to serve as a storage vessel. Nor do known sample chambers/modules sufficiently minimize the dead volume during sampling to reduce contamination of the sample by a pre-filling fluid, such as water.

To address these shortcomings, it is a principal object of the present invention to provide an apparatus and method for bringing a high quality formation fluid sample to the surface for analysis.

It is a further object of the present invention to provide a sample chamber that is safely heatable to at least 400° F. at internal pressures up to 25,000 psi at the surface.

It is a further object of the present invention to provide a sample chamber that is able to be pressurized to maintain a sample in "single phase," meaning that as the sample cools down pressure must be maintained so that components such as gas and asphaltenes, which would normally separate out of the mixture during the pressure reduction caused by the cooling of the sample mixture, will remain in solution. Components that do not stay in solution by maintaining pressure while the sample cools, such as paraffins, can be recombined by applying heat to the chamber at the surface. It is a further object of the present invention to provide a sample chamber that is certified for transportation so that, if desired, the sample can be taken directly to a lab for analysis without the need for transferring the sample from the sample chamber at the wellsite.

It is a further object to provide a sample chamber that is adapted for use as a storage vessel, meaning the sample contents will not leak across the seals that contain the sample within the sample chamber.

It is a further object to provide a sample chamber having a volume that is adequate for proper PVT sampling, but not too large that the sample could not be transferred, if desired, into a separate transportable sample bottle, most of which are 600 cc or less in capacity.

It is a further object to provide an independent validation sample chamber, having a substantially smaller capacity than the sample chamber, that will be safer and easier to heat and recombine separated sample components on the surface for validating the quality of the sample at the well site.

SUMMARY OF THE INVENTION

The objects described above, as well as various other objects and advantages, are achieved by a sample module for use in a downhole tool to obtain fluid from a subsurface formation penetrated by a wellbore. The sample module includes a sample chamber carried by the module for collecting a sample of formation fluid obtained from the formation via the downhole tool, and a validation chamber carried by the module for collecting a substantially smaller sample of formation fluid compared to the sample chamber. The validation chamber is removable from the sample module at the surface without disturbing the sample chamber.

The sample chamber and the validation chamber may be placed in either parallel or serial fluid communication with a fluid flowline in the downhole tool such that the chambers may be filled either substantially simultaneously or consecutively as desired.

Preferably, the sample chamber is adapted for maintaining the sample stored therein in a single phase condition as the sample module is withdrawn with the downhole tool from the wellbore. The phrase "single phase" is used herein to mean that the pressure of the sample within a chamber is maintained or controlled to such an extent that sample constituents which are maintained in a solution through pressure only, such as gasses and asphaltenes, should not separate out of solution as the sample cools upon withdrawal from the wellbore. The sample may be reheated at the surface to recombine the constituents which have come out of solution due to cooling, such as paraffins. Alternatively, the validation chamber may also be adapted for maintaining the fluid sample stored therein in a single phase condition as the sample module is withdrawn from the wellbore.

It is also preferred that the sample chambers be capable of safely withstanding heating at the surface, following collection of samples and withdrawal of the sample module from the wellbore, to temperatures necessary to promote recombination of the sample components within the chambers that may have separated due to cooling upon withdrawal.

It is further preferred that the sample chamber be sufficiently equipped so as to be certified for transportation.

Still further, it is desirable that the sample chamber be adapted for storing the sample collected therein for an indefinite period without substantial degradation of the sample. One solution for achieving this goal is for the sample chamber to include metal-to-metal seals as the final shut-off seals for the sample collected therein.

In another aspect, the present invention provides an improved sample chamber for use in a downhole tool to obtain fluid from a subsurface formation penetrated by a wellbore. The improved sample chamber includes a substantially cylindrical body capable of safely withstanding heating at the surface, following collection of a formation fluid sample via the downhole tool and withdrawal of the sample chamber from the wellbore, to temperatures necessary to promote recombination of the sample components within the chambers. Additionally, the body is sufficiently equipped so as to be certified for transportation. At least one floating piston is slidably positioned within the body so as to define a fluid collection cavity and a pressurization cavity, whereby the pressurization cavity may be charged to control the pressure of the sample collected in the collection cavity. A second such piston may be provided to create a third cavity wherein a buffer fluid may be utilized during sample collection. Metal-to-metal seals act as the final shut-off seals for the sample collected in the collection cavity of the body.

In another aspect, the present invention provides an apparatus for obtaining fluid from a subsurface formation penetrated by a wellbore. The apparatus includes a probe assembly for establishing fluid communication between the apparatus and the formation when the apparatus is positioned in the wellbore, and a pump assembly for drawing fluid from the formation into the apparatus. A sample chamber is provided for collecting a sample of the formation fluid drawn from the formation by the pumping assembly, and a validation chamber is provided for collecting a substantially smaller sample of the formation fluid than the sample chamber. The validation chamber is removable from the apparatus at the surface without disturbing the sample chamber or its contents.

It is preferred that the sample chamber be adapted for maintaining the sample stored therein in a single phase condition as the apparatus is withdrawn from the wellbore. In this regard, the sample chamber may include at least one floating piston slidably positioned within the sample chamber so as to define a fluid collection cavity and a pressurization cavity. A flow line in the apparatus establishes fluid communication between the probe assembly, the pump assembly, and the fluid collection cavity of the sample chamber. A pressurization system in the apparatus charges the pressurization cavity to control the pressure of the collected sample fluid within the collection cavity via the floating piston. The pressurization system preferably includes a valve positioned for fluid communication with the pressurization cavity of the sample chamber, the valve being movable between positions closing the pressurization cavity and opening the pressurization cavity to a source of fluid at a greater pressure than the pressure of the formation fluid delivered to the collection cavity.

The pressurization system controls the pressure of the collected sample fluid within the collection cavity during either collection of the sample from the formation, or retrieval of the apparatus from the wellbore to the surface, or both. For the former purpose, the source of fluid at a greater pressure than the pressure of the collected sample fluid may be wellbore fluid. For the latter purpose, the source of fluid at a greater pressure than the pressure of the collected sample fluid may be a source of inert gas, such as Nitrogen, carried by the apparatus.

The apparatus may be a wireline-conveyed formation testing tool, but is not necessarily so limited.

In another aspect, the present invention contemplates a method for obtaining fluid from a subsurface formation penetrated by a wellbore, and includes the steps of positioning an apparatus within the wellbore, establishing fluid communication between the apparatus and the formation, and inducing movement of fluid from the formation into the apparatus. A sample of the formation fluid moved into the apparatus is delivered to a sample chamber for collection therein, and a substantially smaller sample of the formation fluid moved into the apparatus is delivered to a validation chamber for collection therein. This permits the smaller sample to be evaluated independently of the sample stored in the sample chamber following withdrawal of the apparatus from the wellbore to recover the collected samples.

BRIEF DESCRIPTION OF THE DRAWINGS

The manner in which the present invention attains the above recited features, advantages, and objects can be understood in detail by reference to the preferred embodiments thereof which are illustrated in the accompanying drawings.

It should be noted, however, that the appended drawings illustrate only typical embodiments of this invention and are therefore not to be considered limiting of its scope, for the invention may admit to other equally effective embodiments.

In the drawings:

FIGS. 1 and 2 are schematic illustrations of a prior art formation testing apparatus and its various modular components;

FIG. 3 is a simplified schematic illustration of a sample module for use in a formation tester in accordance with the present invention;

FIG. 3A is a cross-sectional illustration of a sample chamber in accordance with the present invention;

FIG. 4 is a schematic illustration of a basic gas charging system contained in a sample chamber according to the present invention;

FIGS. 5A and 5B are schematic illustrations of two alternative gas charging systems contained in a sample module according to the present invention;

Figure 6A:
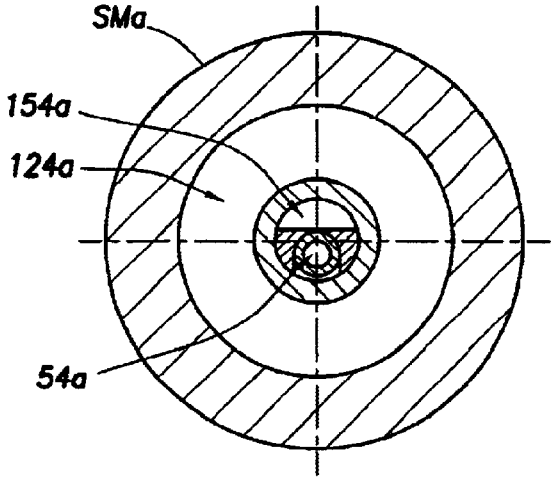
Figure 6B:
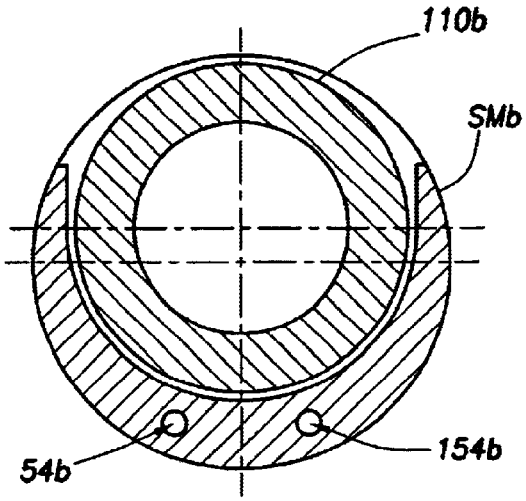
Figure 6C:
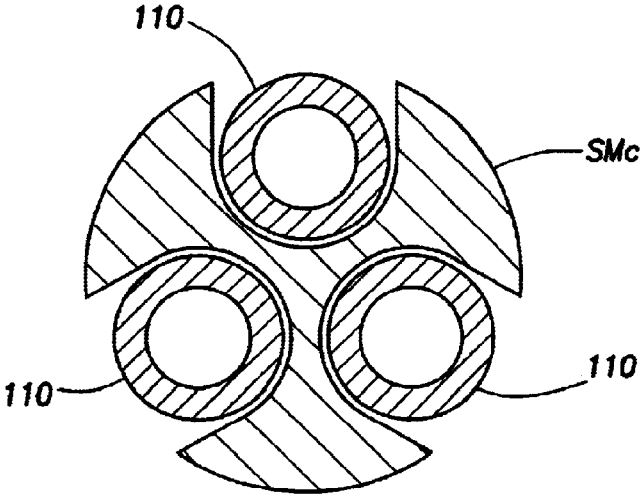
Figure 8:
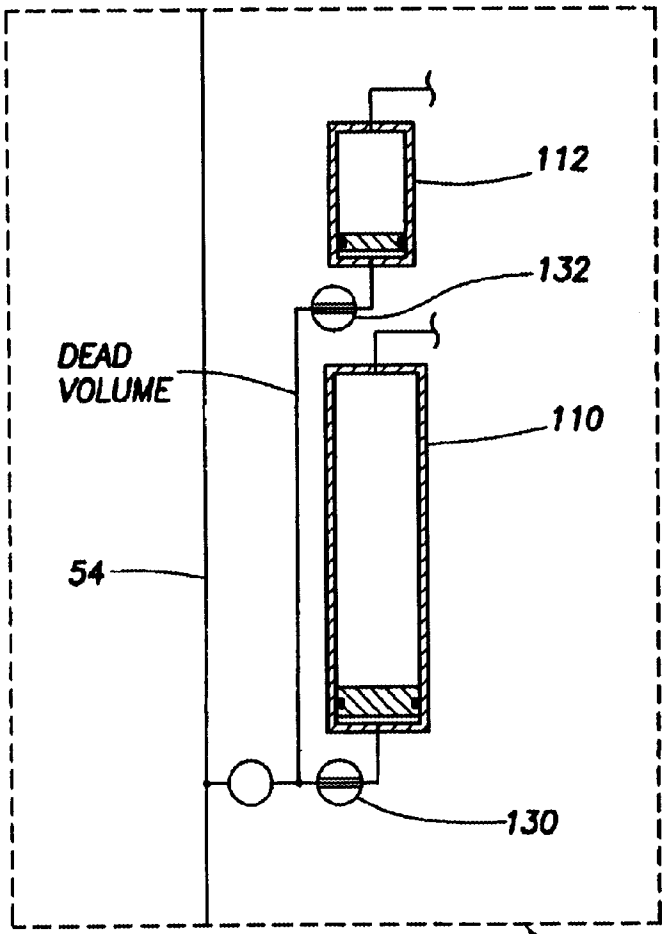
Figure 7:
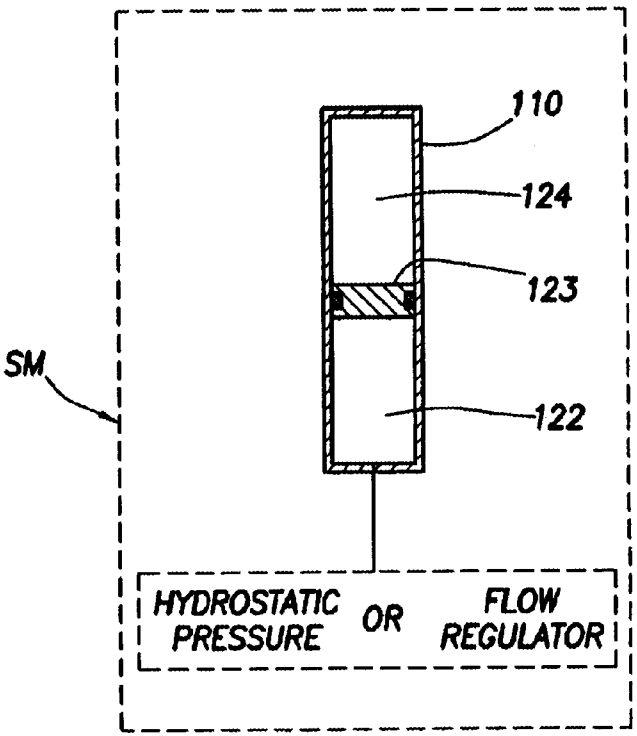
Figure 9B:
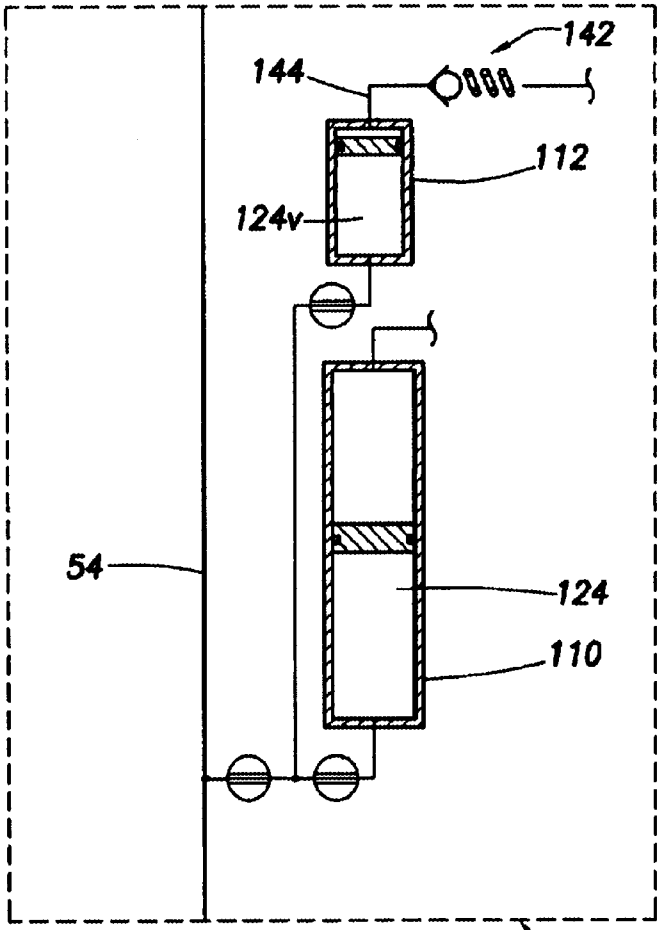
Figure 9A:
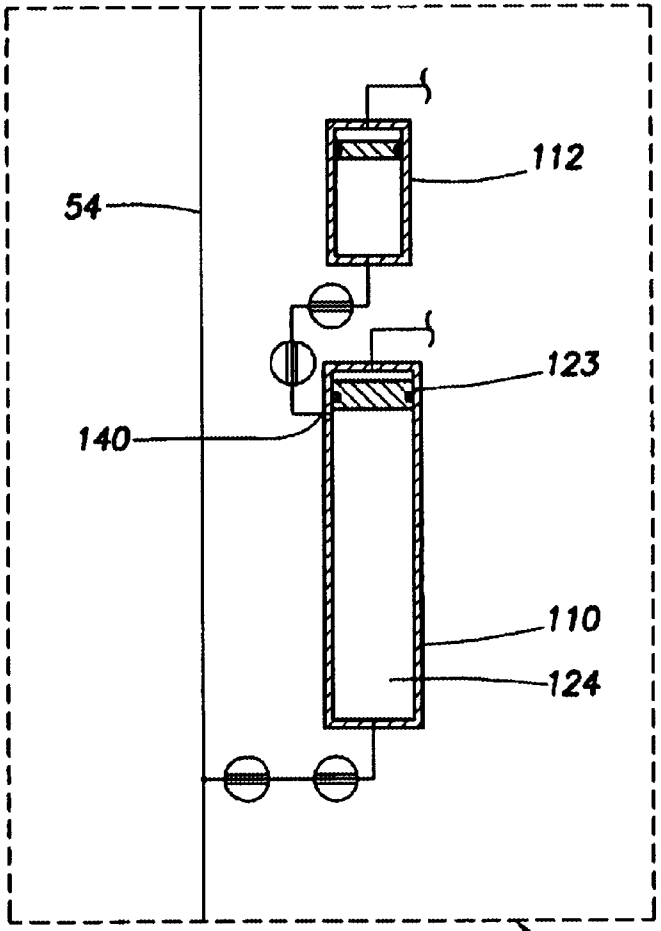
Figure 10B:
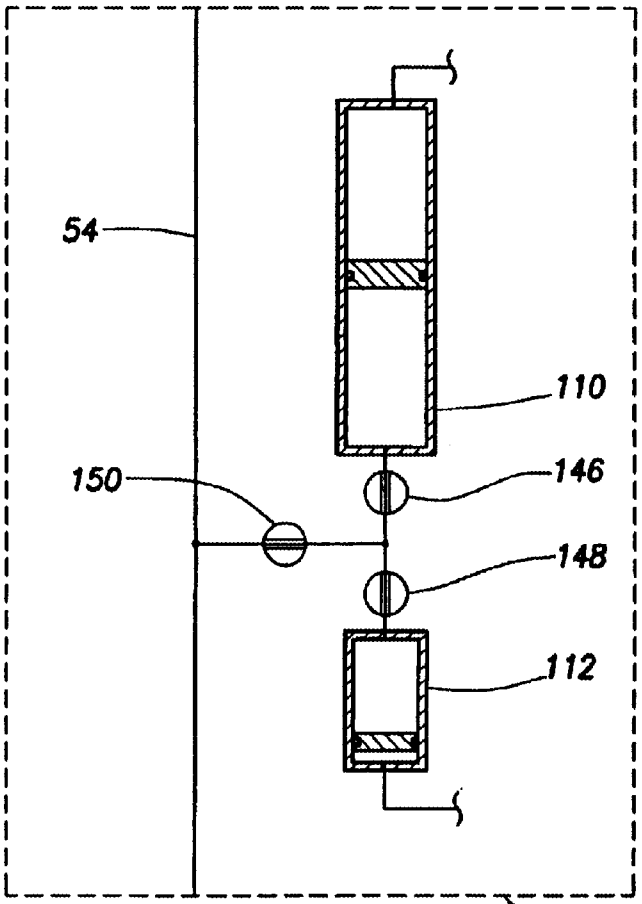
Figure 10A:
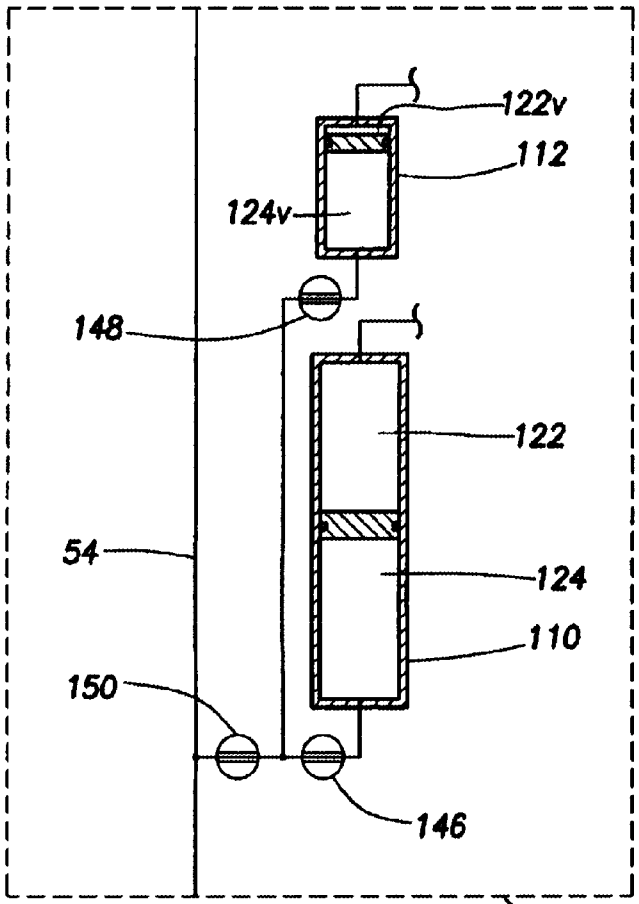
Figure 11C:
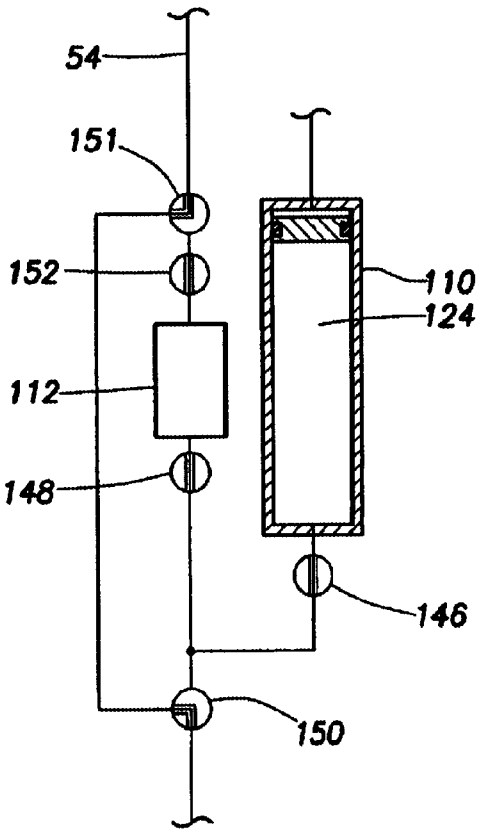
Figure 11B:
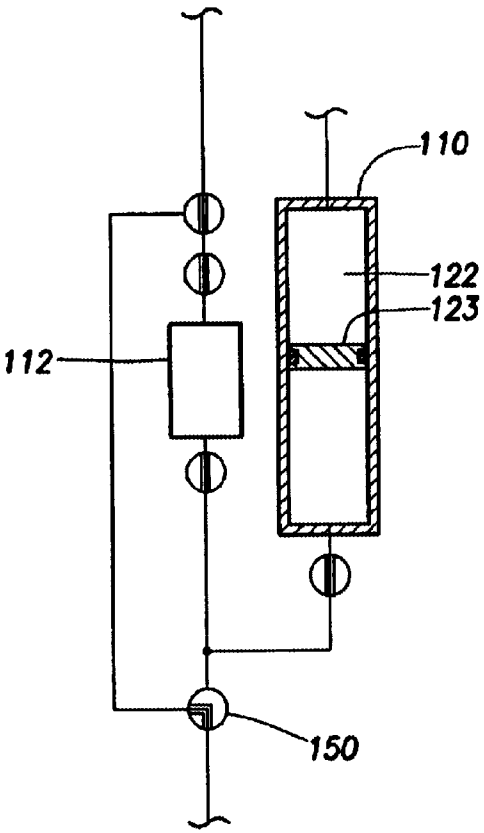
Figure 11A:
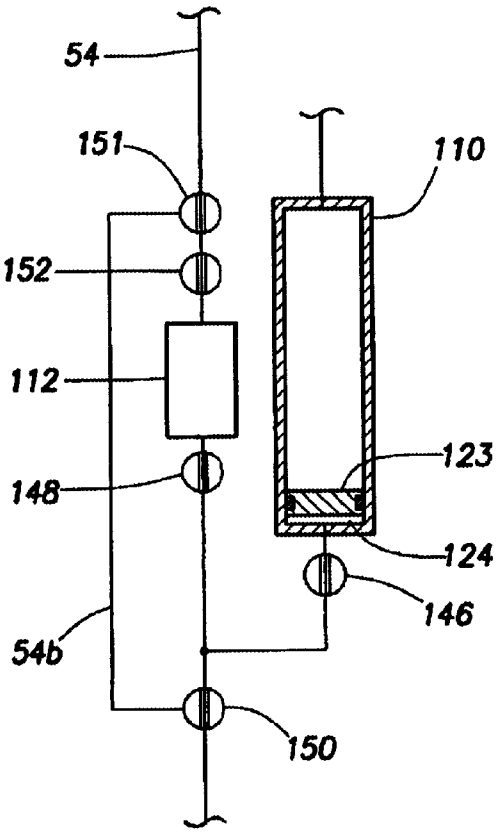
Figure 12:
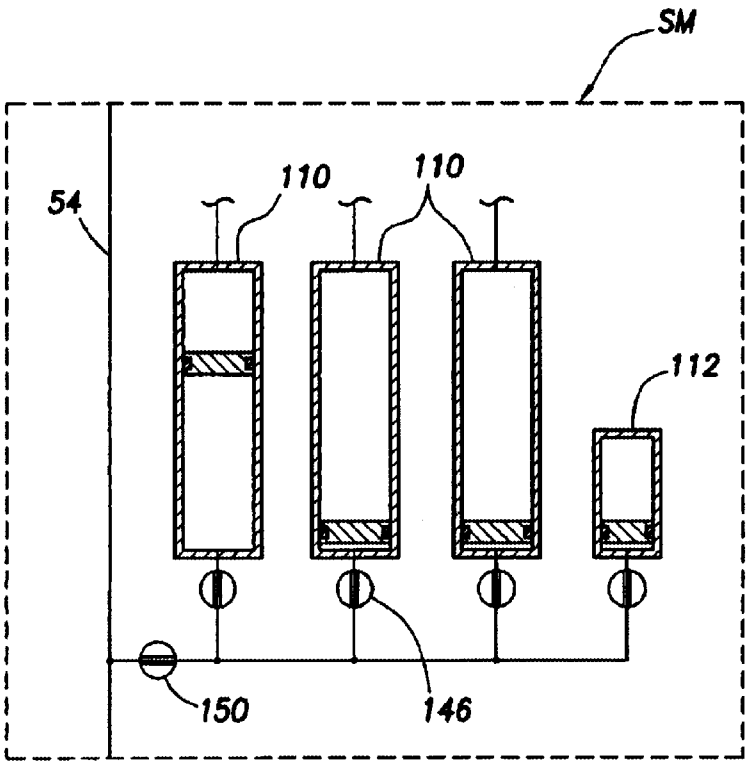

FIGS. 6A–C are cross-sectional illustrations of various alternative embodiments of sample chamber/sample module configurations;

FIG. 7 is a schematic illustration of alternative means for charging a buffer fluid in a sample chamber according to the present invention;

FIG. 8 is a schematic illustration of the concept of dead volume, which is desirable to minimize;

FIGS. 9A and 9B are schematic illustrations of two alternative arrangements for sequentially filling a sample chamber and validation chamber according to the present invention;

FIGS. 10A and 10B are schematic illustrations of two alternative arrangements for filling a sample chamber and validation chamber in parallel according to the present invention;

FIGS. 11A–C are schematic illustrations of three alternative arrangements for sequentially filling a sample chamber and validation chamber by flowing formation fluid through the validation chamber according to the present invention;

FIG. 12 is a schematic illustration of multiple sample chambers arranged for filling in parallel with a validation chamber according to the present invention;

FIGS. 13A–D are schematic illustrations of the of steps involved in filling a sample chamber, shutting in the sample chamber, using a separate gas charging chamber for extracting a portion of the sample from the sample chamber to the validation chamber, and shutting in both the sample and validation chambers; and FIGS. 14A–D are schematic illustrations of the steps involved in flushing formation fluid through a sample module flow line, collecting in parallel samples of the formation fluid in a sample chamber and validation chamber of the sample module, shutting in the collected samples and charging them with gas via a buffer fluid in both chambers, and maintaining the pressure of the collected samples during withdrawal of the sample module to the surface.

Figure 15:
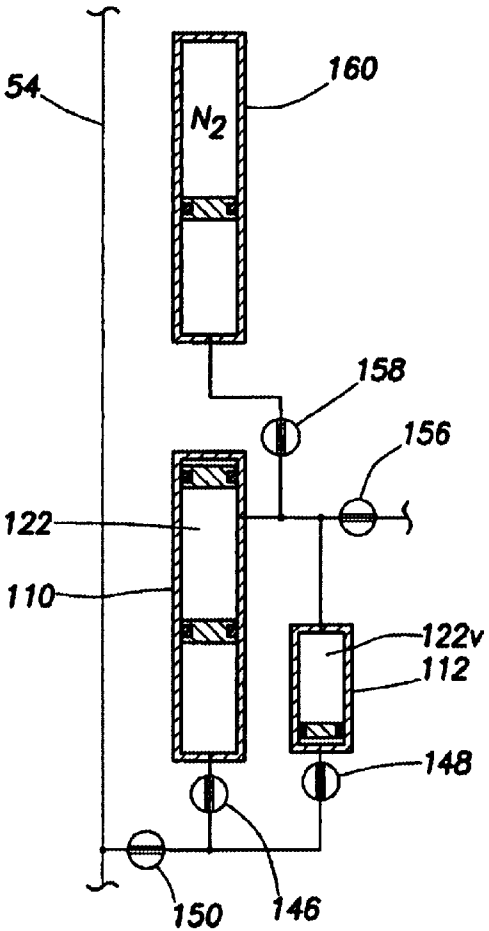

FIG. 15 is a schematic illustration of a sample module incorporating a gas charging chamber that pressurizes buffer fluid in sample and validation chambers independently of a fluid flow line in the sample module.

DETAILED DESCRIPTION OF THE INVENTION

Figure 1:
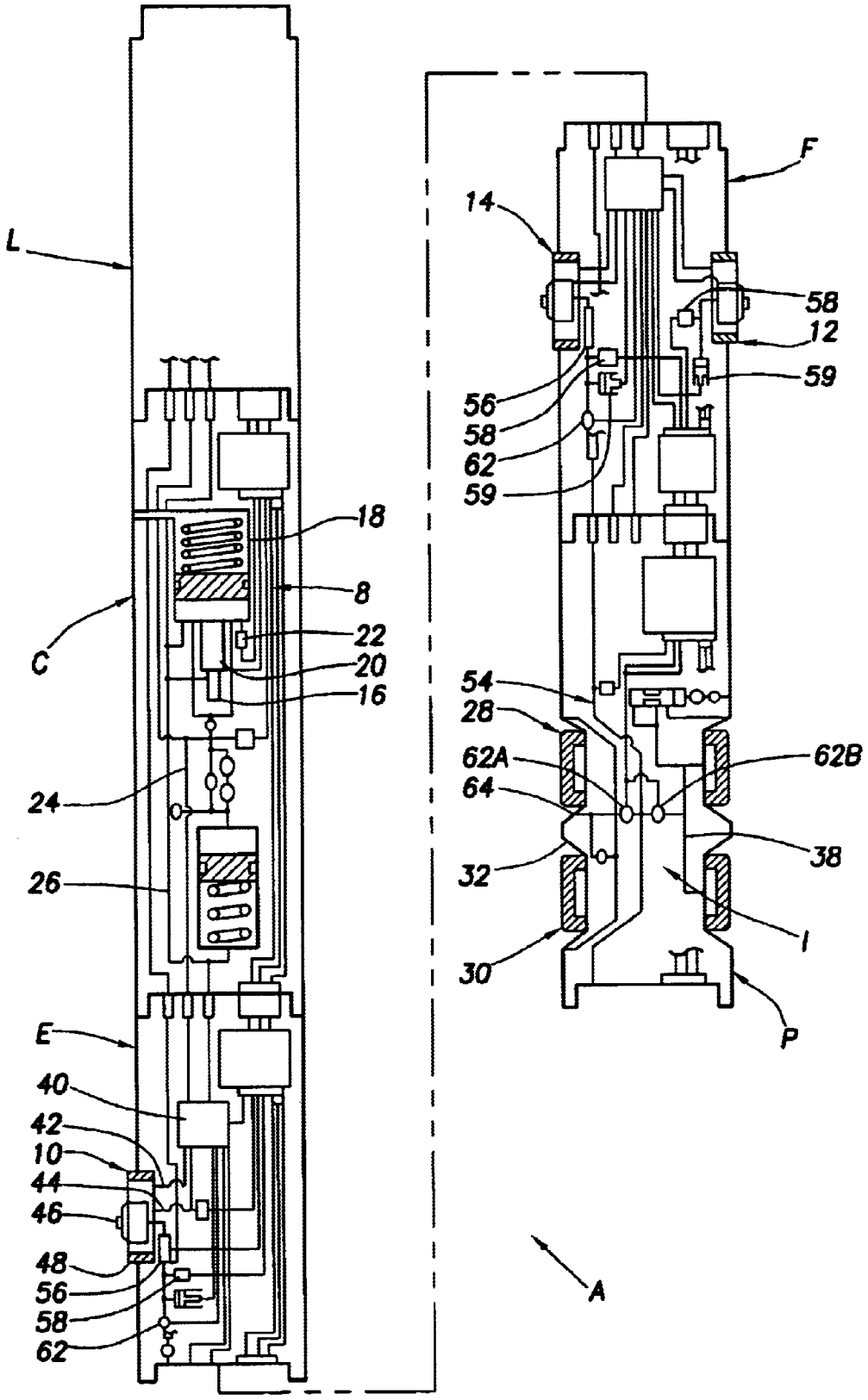
FIG. 1 (PRIOR ART)
Figure 2:
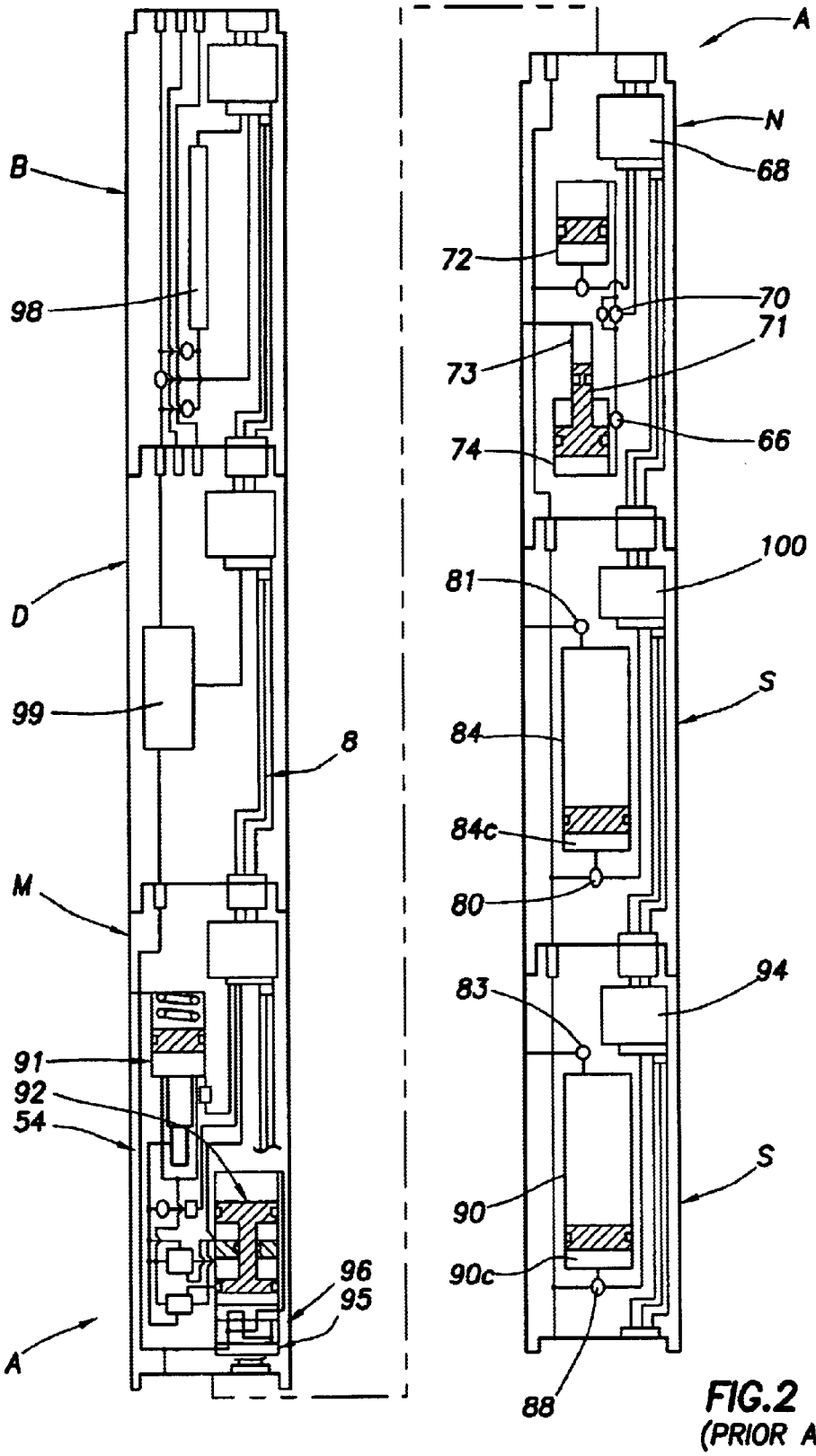
FIG.2 (PRIOR ART)

Turning first to prior art FIGS. 1 and 2, a preferred apparatus with which the present invention may be used to advantage is seen. The apparatus A of FIGS. 1 and 2 is preferably of modular construction although a unitary tool is also useful. The apparatus A is a down hole tool which can be lowered into the well bore (not shown) by a wire line (not shown) for the purpose of conducting formation property tests. The wire line connections to the tool as well as power supply and communications-related electronics are not illustrated for the purpose of clarity. The power and communication lines which extend throughout the length of the tool are generally shown at 8. These power supply and communication components are known to those skilled in the art and have been in commercial use in the past. This type of control equipment would normally be installed at the uppermost end of the tool adjacent the wire line connection to the tool with electrical lines running through the tool to the various components.

As shown in FIG. 1, the apparatus A has a hydraulic power module C, a packer module P, and a probe module E. Probe module E is shown with one probe assembly 10 which may be used for permeability tests or fluid sampling. When using the tool to determine anisotropic permeability and the vertical reservoir structure according to known techniques, a multiprobe module F can be added to probe module E, as shown in FIG. 1. Multiprobe module F has horizontal probe assembly 12 and sink probe assembly 14.

The hydraulic power module C includes pump 16, reservoir 18, and motor 20 to control the operation of the pump. Low oil switch 22 also forms part of the control system and is used in regulating the operation of pump 16. It should be noted that the operation of the pump can be controlled by pneumatic or hydraulic means.

Hydraulic fluid line 24 is connected to the discharge of pump 16 and runs through hydraulic power module C and into adjacent modules for use as a hydraulic power source. In the embodiment shown in FIG. 1, hydraulic fluid line 24 extends through hydraulic power module C into packer module P via probe module E and/or F depending upon which configuration is used. The hydraulic loop is closed by virtue of hydraulic fluid return line 26, which in FIG. 1 extends from probe module E back to hydraulic power module C where it terminates at reservoir 18.

The pump-out module M, seen in FIG. 2, can be used to dispose of unwanted samples by virtue of pumping fluid through flow line 54 into the borehole, or may be used to pump fluids from the borehole into the flow line 54 to inflate straddle packers 28 and 30. Furthermore, pump-out module M may be used to draw formation fluid from the wellbore via probe module E or F, and then pump the formation fluid into sample chamber module S against a buffer fluid therein. This process will be described further below.

Bi-directional piston pump 92, energized by hydraulic fluid from pump 91, can be aligned to draw from flow line 54 and dispose of the unwanted sample though flow line 95 or may be aligned to pump fluid from the borehole (via flow line 95) to flow line 54. The pump out module M has the necessary control devices to regulate pump 92 and align fluid line 54 with fluid line 95 to accomplish the pump out procedure. It should be noted here that pump 92 can be used to pump samples into sample chamber module(s) S, including overpressuring such samples as desired, as well as to pump samples out of sample chamber module(s) S using pump-out module M. Pump-out module M may also be used to accomplish constant pressure or constant rate injection if necessary. With sufficient power, the pump out module may be used to inject fluid at high enough rates so as to enable creation of microfractures for stress measurement of the formation.

Alternatively, straddle packers 28 and 30 shown in FIG. 1 can be inflated and deflated with hydraulic fluid from pump 16. As can be readily seen, selective actuation of the pump-out module M to activate pump 92 combined with selective operation of control valve 96 and inflation and deflation valves I, can result in selective inflation or deflation of packers 28 and 30. Packers 28 and 30 are mounted to outer periphery 32 of the apparatus A, and are preferably constructed of a resilient material compatible with wellbore fluids and temperatures. Packers 28 and 30 have a cavity therein. When pump 92 is operational and inflation valves I are properly set, fluid from flow line 54 passes through inflation/deflation means I, and through flow line 38 to packers 28 and 30.

As also shown in FIG. 1, the probe module E has probe assembly 10 which is selectively movable with respect to the apparatus A. Movement of probe assembly 10 is initiated by operation of probe actuator 40, which aligns hydraulic flow lines 24 and 26 with flow lines 42 and 44. Probe 46 is mounted to a frame 48, which is movable with respect to apparatus A, and probe 46 is movable with respect to frame 48. These relative movements are initiated by controller 40 by directing fluid from flow lines 24 and 26 selectively into flow lines 42 and 44 with the result being that the frame 48 is initially outwardly displaced into contact with the borehole wall (not shown). The extension of frame 48 helps to steady the tool during use and brings probe 46 adjacent the borehole wall. Since one objective is to obtain an accurate reading of pressure in the formation, which pressure is reflected at the probe 46, it is desirable to further insert probe 46 through the built up mudcake and into contact with the formation. Thus, alignment of hydraulic flow line 24 with flow line 44 results in relative displacement of probe 46 into the formation by relative motion of probe 46 with respect to frame 48. The operation of probes 12 and 14 is similar to that of probe 10, and will not be described separately.

Having inflated packers 28 and 30 and/or set probe 46 and/or probes 12 and 14, the fluid withdrawal testing of the formation can begin. Sample flow line 54 extends from probe 46 in probe module E down to the outer periphery 32 at a point between packers 28 and 30 through adjacent modules and into the sample modules S. Vertical probe 46 and sink probes 12 and 14 thus allow entry of formation fluids into sample flow line 54 via one or more of a resistivity measurement cell 56, a pressure measurement device 58, and a pretest mechanism 59, according to the desired configuration. When using module E, or multiple modules E and F, isolation valve 62 is mounted downstream of resistivity sensor 56. In the closed position, isolation valve 62 limits the internal flow line volume, improving the accuracy of dynamic measurements made by pressure gauge 58. After initial pressure tests are made, isolation valve 62 can be opened to allow flow into other modules.

When taking initial samples, there is a high prospect that the formation fluid initially obtained is contaminated with mud cake and filtrate. It is desirable to purge such contaminants from the sample flow stream prior to collecting sample(s). Accordingly, the pump-out module M is used to initially purge from the apparatus A specimens of formation fluid taken through inlet 64 of straddle packers 28, 30, or vertical probe 46, or sink probes 12 or 14 into flow line 54.

Fluid analysis module D included optical fluid analyzer 99 which is particularly suited for the purpose of indicating where the fluid in flow line 54 is acceptable for collecting a high quality sample. Optical fluid analyzer 99 is equipped to discriminate between various oils, gas, and water. U.S. Pat. Nos. 4,994,671; 5,166,747; 5,939,717; and 5,956,132, as well as other known patents, all assigned to Schlumberger, describe analyzer 99 in detail, and such description will not be repeated herein, but is incorporated by reference in its entirety.

While flushing out the contaminants from apparatus A, formation fluid can continue to flow through sample flow line 54 which extends through adjacent modules such as precision pressure module B, fluid analysis module D, pump out module M (FIG. 2), flow control module N, and any number of sample chamber modules S that may be attached. Those skilled in the art will appreciate that by having a sample flow line 54 running the length of various modules, multiple sample chamber modules S can be stacked without necessarily increasing the overall diameter of the tool. Alternatively, as explained below, a single sample module S may be equipped with a plurality of small diameter sample chambers, for example by locating such chambers side by side and equidistant from the axis of the sample module (See FIG. 6C). The tool can therefore take more samples before having to be pulled to the surface and can be used in smaller bores.

Referring again to FIGS. 1 and 2, flow control module N includes a flow sensor 66, a flow controller 68 and a selectively adjustable restriction device such as a valve 70. A predetermined sample size can be obtained at a specific flow rate by use of the equipment described above in conjunction with reservoirs 72, 73, and 74. Reservoir 74 is pressure balanced with approximately ⅓ wellbore pressure, by way of piston 71 and the reduced diameter of reservoir 73 relative to reservoir 74. This is one example wherein wellbore fluid is used as a buffer fluid to control the pressure of fluid in flow line 54, and the pressure of a sample being taken.

Sample chamber module S can then be employed to collect a sample of the fluid delivered via flow line 54 where the piston motion is controlled via the buffer fluid from the non-sample side of the piston being regulated by flow control module N, which is beneficial but not necessary for fluid sampling. With reference first to upper sample chamber module S in FIG. 2, a valve 80 is opened and valves 62, 62A and 62B are held closed, thus directing the formation fluid in flow line 54 into sample collecting cavity 84C in chamber 84 of sample chamber module S, after which valve 80 is closed to isolate the sample. The tool can then be moved to a different location and the process repeated. Additional samples taken can be stored in any number of additional sample chamber modules S which may be attached by suitable alignment of valves. For example, there are two sample chambers S illustrated in FIG. 2. After having filled the upper chamber by operation of shut-off valve 80, the next sample can be stored in the lowermost sample chamber module S by opening shut-off valve 88 connected to sample collection cavity 90C of chamber 90. It should be noted that each sample chamber module has its own control assembly, shown in FIG. 2 as 100 and 94. Any number of sample chamber modules S, or no sample chamber modules, can be used in particular configurations of the tool depending upon the nature of the test to be conducted. Also, sample module S may be a multi-sample module that houses a plurality of sample chambers, as mentioned above and described below.

It should also be noted that buffer fluid in the form of full-pressure wellbore fluid may be applied to the backsides of the pistons in chambers 84 and 90 to further control the pressure of the formation fluid being delivered to sample modules S. For this purpose, valves 81 and 83 are opened, and pump 92 of pump-out module M must pump the fluid in flow line 54 to a pressure exceeding wellbore pressure. It has been discovered that this action has the effect of dampening or reducing the pressure pulse or "shock" experienced during drawdown. This low shock sampling method has been used to particular advantage in obtaining fluid samples from unconsolidated formations.

It is known that various configurations of the apparatus A can be employed depending upon the objective to be accomplished. For basic sampling, the hydraulic power module C can be used in combination with the electric power module L, probe module E and multiple sample chamber modules S. For reservoir pressure determination, the hydraulic power module C can be used with the electric power module L, probe module E and precision pressure module B. For uncontaminated sampling at reservoir conditions, hydraulic power module C can be used with the electric power module L, probe module E in conjunction with fluid analysis module D, pump-out module M and multiple sample chamber modules S. A simulated Drill Stem Test (DST) test can be run by combining the electric power module L with packer module P, and precision pressure module B and sample chamber modules S. Other configurations are also possible and the makeup of such configurations also depends upon the objectives to be accomplished with the tool. The tool can be of unitary construction a well as modular, however, the modular construction allows greater flexibility and lower cost, to users not requiring all attributes.

As mentioned above, sample flow line 54 also extends through a precision pressure module B. Precision gauge 98 of module B should preferably be mounted as close to probes 12, 14 or 46 as possible to reduce internal flow line length which, due to fluid compressibility, may affect pressure measurement responsiveness. Precision gauge 98 is more sensitive than the strain gauge 58 for more accurate pressure measurements with respect to time. Gauge 98 is preferably a quartz pressure gauge that performs the pressure measurement through the temperature and pressure dependent frequency characteristics of a quartz crystal, which is known to be more accurate than the comparatively simple strain measurement that a strain gauge employs. Suitable valving of the control mechanisms can also be employed to stagger the operation of gauge 98 and gauge 58 to take advantage of their difference in sensitivities and abilities to tolerate pressure differentials.

The individual modules of apparatus A are constructed so that they quickly connect to each other. Preferably, flush connections between the modules are used in lieu of male/female connections to avoid points where contaminants, common in a wellsite environment, may be trapped.

Flow control during sample collection allows different flow rates to be used. Flow control is useful in getting meaningful formation fluid samples as quickly as possible which minimizes the chance of binding the wireline and/or the tool because of mud oozing into the formation in high permeability situations. In low permeability situations, flow control is very helpful to prevent drawing formation fluid sample pressure below its bubble point or asphaltene precipitation point.

More particularly, the "low shock sampling" method described above is useful for reducing to a minimum the pressure drop in the formation fluid during drawdown so as to minimize the "shock" on the formation. By sampling at the smallest achievable pressure drop, the likelihood of keeping the formation fluid pressure above asphaltene precipitation point pressure as well as above bubble point pressure is also increased. In one method of achieving the objective of a minimum pressure drop, the sample chamber is maintained at wellbore hydrostatic pressure as described above, and the rate of drawing connate fluid into the tool is controlled by monitoring the tool's inlet flow line pressure via gauge 58 and adjusting the formation fluid flowrate via pump 92 and/or flow control module N to induce only the minimum drop in the monitored pressure that produces fluid flow from the formation. In this manner, the pressure drop is minimized through regulation of the formation fluid flowrate.

Figure 3:
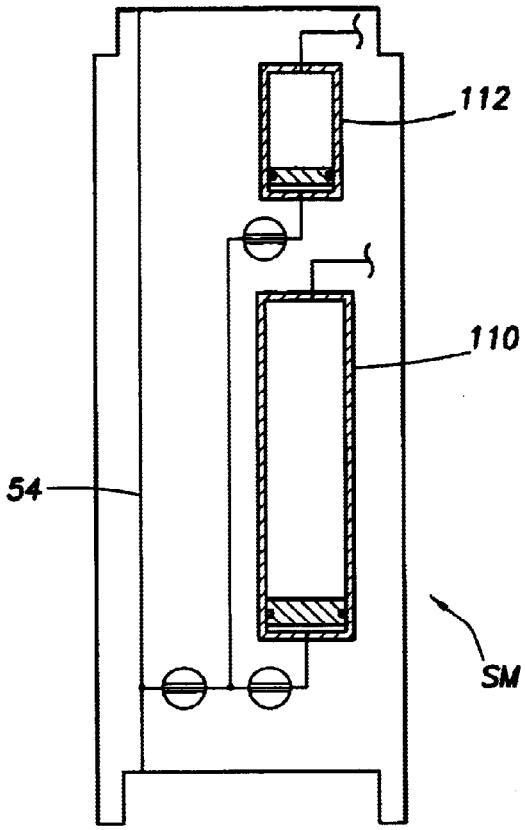

Turning now to FIG. 3, one aspect of the present invention is schematically illustrated in the form of sample module SM adapted for use in a downhole tool such as the formation testing tool A described above. It should be noted, however, that the present invention exhibits utility in downhole tools other than a wireline-conveyed formation testing tool, such as in drill pipe strings and coiled tubing, although wireline tools are the presently preferred choice for use. Sample module SM includes sample chamber 110 for collecting a full-sized PVT sample of the formation fluid obtained via the downhole tool in accordance with the apparatus and method described above.

Figure 3A:
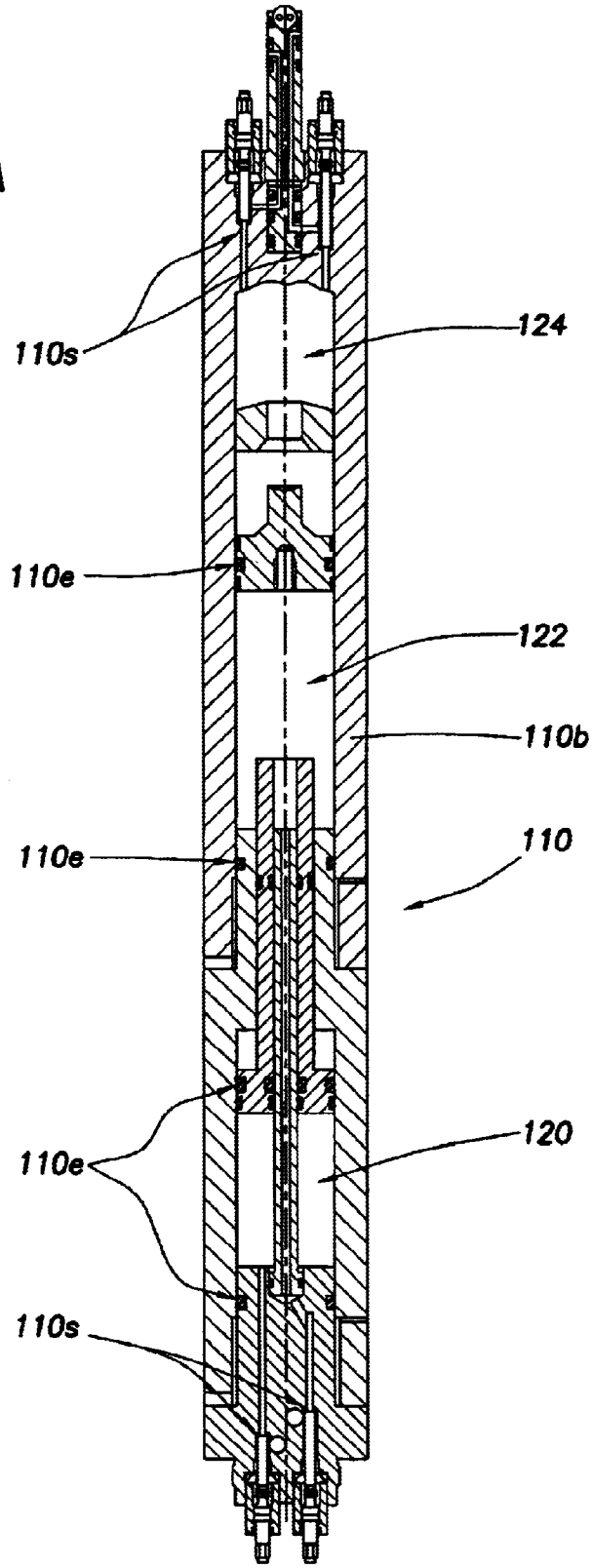

Sample chamber 110, which is shown more particularly in FIG. 3A, is itself an improvement over the art, and includes a substantially cylindrical steel alloy body 110*b* that is capable of safely withstanding reheating at the surface following withdrawal of the sample chamber from the wellbore to temperatures necessary to promote recombination of the sample components within the chamber. Such temperatures are typically no higher than 150° F., but may be as high as 400° F. in some conditions, such as when samples are taken from very deep wells. Surface reheating is typically accomplished through the application of heating tape to the exterior of the sample chamber or by immersing the chamber in a temperature-controlled reservoir or bath. Pressure is monitored during such heating through the connection of a gauge to a sealed port provided in the sample chamber. The primary means for the sample chamber to safely withstand such temperatures is to equip the chamber body with metal-to-metal seals 110*s* for isolating the samples collected therein, and to provide means such as, possibly, a relief valve or connection to the sample fluid or the buffer fluid with a pressure control device for bleeding off excess pressure that may develop within the chamber body when it's reheated at the surface.

Additionally, the sample chamber body 110*b* should be sufficiently equipped so as to be certified for transportation. Essentially, this requires that the sample volume be limited to 600 cc, and that a minimum ten percent gas cap exists inside the chamber body that protects the potentially volatile hydrocarbon contents collected therein in the event of impact to the body. The use of such gas cap charging is described further below.

Still further, it is desirable for sample chamber 110 to be equipped to store the sample collected therein for an indefinite period without substantial degradation of the sample. One solution for achieving this goal is for the sample chamber to include metal-to-metal seals 110*s* therein as the final shut-off seals for the sample collected therein, as mentioned previously. Thus, the use of metal-to-metal seals instead of elastomeric seals provides several advantages to sample chamber 110.

Referring again to FIG. 3A, sample module SM further includes validation chamber 112, essentially a smaller version of sample chamber 110, for collecting a substantially smaller sample of formation fluid than the larger full-sized sample chamber. In this regard, sample sizes on the order of 500–600 cc are collected in sample chamber 110 and 50–60 cc in validation chamber 112 are presently preferred, whereby the weight of the validation chamber is substantially reduced and it is safer to reheat at the well site compared to the sample chamber. Another particular advantage of the validation chamber is that it's removable from the sample module at the surface without disturbing the sample chamber, and, more particularly, the sample collected in the sample chamber. The validation chamber is also heatable to promote recombination of the sample fluid components that may have separated during withdrawal from the wellbore, but is not transportable since its contents will be examined at the well site to validate the full-sized sample collected in sample chamber 110.

The smaller validation sample is taken downhole along with the larger "PVT" sample either sequentially or in parallel, and also may be displaced from the full size sample as well as taken separately from the full size sample. It is important, however, that the validation sample be taken at substantially the same time as the PVT sample to minimize variation between the two samples. In addition to being safer and easier to reheat than the much larger full-sized PVT sample, the validation sample is also much easier to promote recombination of its components through such heating on the surface. Typically, validation at the surface does not entail a full PVT analysis because the primary concern is contamination discovery. Because of this, the validation sample can either be maintained in single phase (again, meaning pressure compensated) or not.

Those skilled in the art will appreciate sample module SM can be combined to advantage with downhole tools, such as formation tester A, to improve the fluid sampling capabilities that such tools provide. In that regard, the present invention contemplates an improved downhole tool for obtaining reliable, high quality formation fluid samples that includes a probe assembly (see the description of probe modules E, F above, for example) for establishing fluid communication between the apparatus and a subsurface formation, and a pump assembly (see, for example, the description of pump-out module M above) for drawing fluid from the formation into the apparatus, in combination with improved sample module SM.

There are several different methods for achieving a high (PVT) quality sample and a validation sample. The most crucial attribute is that of maintaining a single phase sample from the time when the sample is taken (at least the PVT sample) to when it is analyzed. This is preferably accomplished by charging the sample with an inert gas which, by nature, loses much less pressure when the sample temperature drops during withdrawal of the sample chamber from the wellbore. The gas charging system can be contained in either the sample chamber itself or can be contained in the sample module, and preferably utilizes Nitrogen gas for charging purposes.

Figure 4:
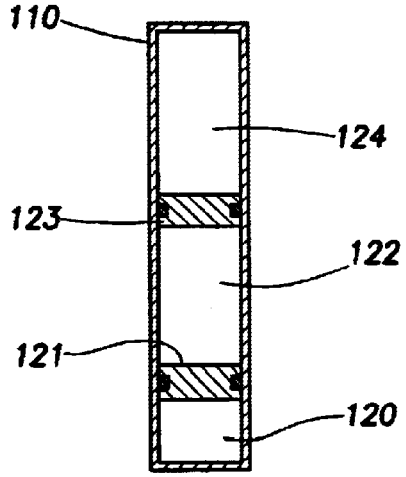

FIGS. 4 and 5 show two methods for gas charging. The concept of maintaining a gas cap on the back of a collected sample to minimize pressure reduction caused by cooling of the sample, and increase the likelihood of maintaining a "single-phase" sample, is schematically illustrated. In addition to facilitating recombination of the sample components under heating, a single-phase sample makes transferring of the sample, should it be needed, much safer for sample integrity. The concept of overcharging a collected fluid sample with gas is generally known, and is explained fully in U.S. Pat. No. 5,337,822, assigned to OilPhase Sampling Services, a division of Schlumberger, the contents of which patent are incorporated herein by reference.

FIG. 4 illustrate the use of a gas charge within sample chamber 110. The gas charge is introduced beforehand via a port (not shown) in sample chamber 110 into pressurization cavity 120 and pressurizes a buffer fluid in cavity 122 through piston 121. The buffer fluid in cavity 122 in turn pressurizes the sample in collection cavity 124 through piston 123. In this example, the charging gas is charged to a set pressure before sample chamber 110 is run into the wellbore on a downhole tool depending on the expected well conditions. Sample chamber 110 may also include stop mechanisms (not shown, but described below in regard to FIGS. 14A–D) which, upon closure of the sample chamber, permit either the charging gas in cavity 120 to move piston 121 or the buffer fluid in cavity 122 to move piston 123. Either way, the pressure from the charging gas is utilized to control the sample fluid pressure in collection cavity 124 after the sample has been taken. Piston 123 includes elastomeric seals (labeled 110*e* in FIG. 3A), but since the buffer fluid and the collected sample are at the same pressure there is no pressure-induced migration of gases across the elastomeric seals.

Figure 5A:
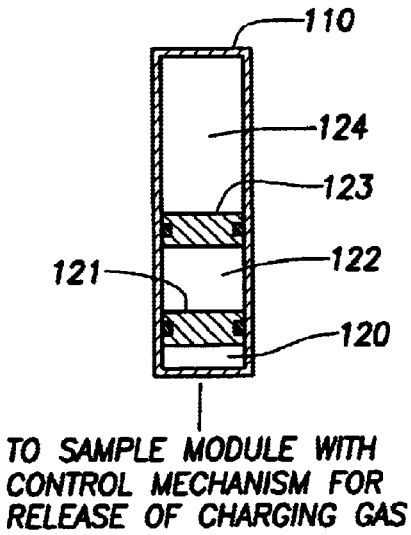
Figure 5B:
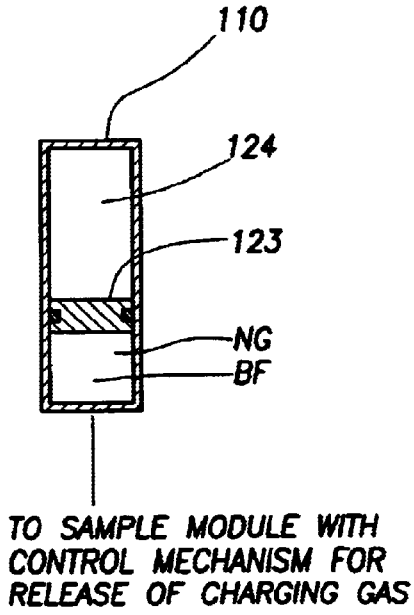

The gas charge configuration can be rearranged in several different ways, two more of which are illustrated in FIGS. 5A and 5B. In these figures, the charging gas is located in sample module SM (not shown) within which sample chamber 110 is carried. The control mechanism for releasing the charging gas is also in the sample module and is activated when the sample section of the sample chamber has been closed through the action of one or more shut-off valves. These configurations allow for a smaller, less complicated sample chamber 110 because the gas control mechanism is located outside the chamber. FIG. 5A illustrates piston 121 separating the charging gas in cavity 120 and the buffer fluid in cavity 122, and piston 123 separating buffer fluid cavity 122 from formation fluid collection cavity 124. FIG. 5B shows an alternative configuration wherein nitrogen gas NG is charged directly into the pressurization cavity, whereby it mixes with buffer fluid BF to charge sample fluid in cavity 124 as desired.

There are other methods for maintaining pressure on a sample such as an electromechanical system which senses the pressure via a pressure gauge (not shown) sensing the pressure of cavity 124 and acts to maintain the pressure above a set limit. Such methods are contemplated by and within the scope of the present invention, but are not described further herein.

In order to allow wiring and fluid flow lines to pass through the sample module, there are certain design constraints on the sample chambers. There are two basic methods of designing the sample module. One module, referred to as SMa, can be thought of as a canoe style module and the other module, referred to as SMb, can be considered an annular style module. The two basic concepts are shown respectively in FIGS. 6A and 6B, along with variation SMc of the canoe style concept with multiple sample chambers in FIG. 6C.

Canoe style module SMb is equipped with a U-shaped channel for receiving the elongated cylindrical sample chamber 110*b*, and permits sample chamber 110*b* to be much simpler in design (essentially a tubular pressure vessel), allowing the sample chamber to be a more cost effective transport and storage vessel. However, the canoe style module makes a more complicated carrier due to the routing of the power/control/communication wiring passage 154*b* and flowline 54*b* as seen in FIG. 6B.

The annular style module SMa, on the other hand, makes the routing of wiring and fluid passages 154*a* and 54*a* simpler, but complicates the sample chamber 110*a* as shown by the tube within a tube within a tube design of FIG. 6A. In this embodiment, sample fluid is collected in annulus cavity 124*a*.

FIG. 6C shows the canoe style sample module expanded to allow multiple sample chambers 110 within the confines of respective U-shaped channels. Again, the canoe style module makes a more complicated carrier due to the routing of the wiring passage and flowline passage (neither of which are shown here), but a simpler, removable sample chamber.

As mentioned above, sample chamber 110 must be transportable, meaning it must meet the design requirements of transportation regulating agencies such as the U.S. Department of Transportation and Transport Canada, as well as others having jurisdiction over the region(s) wherein the tool is used. The sample chamber is also designed to serve as an acceptable storage container. To achieve these goals, no elastomeric seals are used to maintain sample pressure after the chamber is shut in by an operator when the tool reaches the surface. Thus, the present invention entails minimizing or eliminating any elastomeric seals which hold the pressurized sample. The final shut-in seals that are actuated either downhole or on the surface after the sample is taken should all be metal-to-metal so that gases do not migrate across the seals thereby disrupting the actual sample components. Minimizing elastomeric seals will also make the container safer for heating because elastomeric seals are not adequate for long heating/pressure cycles, although the use of elastomeric seals that are pressure balanced, such as by buffer fluid, in contact with the sample is permitted.

Along with being transportable and storable, sample chamber 110 must be heatable to reservoir conditions and, as such, the design safety factors must allow for safe heating of the vessel to temperatures up to 400° F. at pressures up to 25,000 psi). A pressure relief system (see, for example, the relief valve shown in FIG. 9B) may be incorporated if needed to mitigate the potential safety hazard of an over-pressurized chamber. The preferred method for such a system is to monitor the pressure within the sample chamber and provide the ability to manually bleed off fluid pressure through a connection to the chamber.

The sample chamber also allows a formation fluid sample to be taken at a minimum pressure drop just below reservoir pressure, and then raised to a pressure at or above reservoir pressure, in some cases substantially above reservoir pressure and even above wellbore pressure. The latter requirement entails that there is a buffer fluid at or above reservoir pressure against which the sample must be pumped, as described above in regard to formation testing tool A. The sample chamber may also need to allow the buffer fluid to be channeled to a device that can control the fluid flow so that the rate of the sample being taken can be controlled and therefore the buffer fluid must be routed back into the flow line.

FIG. 7 schematically illustrates sample module SM and sample chamber 110 having a buffer fluid in cavity 122 in pressure communication via piston 123 with the sample collected in cavity 124 so that the pressure drawdown on the sample can be minimized. This can be done by putting the buffer fluid in communication with hydrostatic wellbore pressure (Low Shock Sampling), by routing the buffer fluid to a conventional flow regulator carried by sample module SM, or by routing the fluid to the flow line and regulating with a flow control module like module N described above for tool A.

"Dead volume" refers to the volume of fluid or gas which is contained in the fluid flow lines and the sample chambers which does not get extracted when the sample is taken. In other words, it is superfluous volume that is trapped in communication with the sample during sample collection. This dead volume fluid or gas is therefore mixed in with the sample fluid and contaminates the sample. In the described design, some dead volume is practically unavoidable, but it is desirable to minimize this volume to ensure a PVT quality sample.

The sample module and sample chamber of the present invention also minimize "dead volume" and prevent the loss of gas when shut in. Dead volume fluid typically consists of air or some other fluid such as water, which is generally used to prefill the flow lines in sample module SM. Dead volume is primarily minimized by limiting the length of flow line between isolating valves and the sample and validation chambers, as well as by minimizing the flow line length between these chambers. FIG. 8 shows a span of dead volume fluid defined by the flow line length between shut-off valves 130 and 132, which length the present invention minimizes to avoid sample contamination. Examples of different embodiments that minimize dead volume are shown below.

While sampling, it is usually desirable to take at least two if not three PVT quality samples in the same zone at the same time. Therefore, sample module SM should allow multiple sample chambers 110 to be filled at the same sampling depth. It is preferable that the sample module include at least two PVT sample chambers 110 for filling with formation fluid at each sampling point. The chambers can be filled either in series (one after the other) or in parallel. The distance between their entrance ports shall be minimized in order to ensure the similarity of the fluid entering each chamber, and to minimize dead volume.

Several possible combinations of PVT sample chambers and validation sample chambers are shown in FIGS. 9 through 12. FIGS. 9A and 9B illustrate two alternative embodiments for arranging sample chamber 110 and validation chamber 112 for sequential, or serial, filling thereof. Sequential filling refers to the fact that one sample chamber is filled prior to another chamber.

FIG. 9A shows the concept fulfilled by placing an outlet port 140 near the end of the stroke of sample piston 123 such that collection cavity 124 of sample chamber 110 will completely fill before outlet port 140 is opened to fluid pressure provided via flow line 54 and the sample starts filling validation chamber 112.

FIG. 9B shows relief valve 142 placed in the buffer fluid outlet line 144 of validation chamber 112. Relief valve 142 is designed to remain closed, thereby preventing fluid flow into validation sample collection cavity 124*v*, until the sample in cavity 124 of sample chamber 110 is pressurized above the relief valve relief-pressure setting. This will cause the full size sample chamber 110 to fill before smaller validation chamber 112. It should be noted that the serial filling configuration of FIG. 9B results in more dead volume than that of FIG. 9A, wherein dead volume is minimized, due to increased flow line length in the embodiment of FIG. 9B.

FIGS. 10A and 10B illustrate two alternative embodiments for arranging sample chamber 110 and validation chamber 112 for parallel filling thereof. Parallel filling refers to the process of allowing both chambers to fill substantially simultaneously.

In FIG. 10A, chambers 110 and 112 are filled in parallel by opening seal valve 150 and shut-off valves 146 and 148 to permit fluid in flow line 54 to fill respective collection cavities 124 and 124*v*. Buffer fluid cavities 122 and 122*v* are open to buffer fluids having substantially the same pressure, or to the same buffer fluid source, resulting in substantially simultaneous filling of chambers 110 and 112.

FIG. 10B shows an alternative parallel filling configuration which will decrease the amount of dead volume as compared to the embodiment of FIG. 10A because of the compact arrangement of the fluid flow lines and valves 150, 146, and 148. In the particular configuration shown, validation chamber 112 has been inverted from its orientation in FIG. 10A to accommodate the central placement of shut-off valves 146 and 148.

In practice, parallel filling arrangements will most likely result in one chamber filling before the other due to differences in friction. Therefore, this method could technically be considered sequential, but the order of chamber filling is not forced like in the pure sequential modes shown in FIGS. 9A and 9B.

Most sample chamber designs utilize at least one piston for several reasons, including minimizing the dead volume, controlling the pressure drop on the sample, easing extraction the sample for analysis, and for simplifying the design. FIGS. 11A–C illustrate schematically a sample module arrangement wherein validation chamber 112 is provided with no pistons therein. FIG. 11A shows sample chamber 110 arranged serially with validation chamber 112 via flow line 54. Shut-off valves 152, 148, and 146 are all open, and seal valves 150 and 151 are set to permit flow through validation chamber 112 and seal valve 150 whereby no fluid is directed into sample chamber 110.

In FIG. 11B, seal valve 150 has been set to direct fluid flowing through validation chamber 112 into fluid collection cavity 124 of sample chamber 110. In this figure, piston 123 has been moved from the bottom of sample chamber 110 to a level approximately halfway up the chamber's internal volume, expelling buffer fluid in cavity 122.

Once piston 123 is moved upwardly to its full extent within sample chamber 110, seal valve 151 is set to direct fluid in flow line 54 to bypass validation chamber 112 and sample chamber 110. This action, shown in FIG. 11C, has the effect of shutting in the samples collected within chambers 112 and 110. Shut-off valves 152, 148, and 146 may also be closed at this time as desired.

FIG. 12 shows that multiple sample chambers can be filled from one flow line 54 to capture multiple samples of reservoir fluids from one sampling point simultaneously. The arrangement includes three full-sized sample chambers 110 and one validation chamber 112 connected in parallel with appropriate flow lines and valving. Those skilled in the art will appreciate that such a multiple chamber arrangement could be connected sequentially as well.

It will also be appreciated that FIGS. 9–12 do not show gas charge for simplification. In practice, the PVT sample chambers 110 will be provided with a gas charge pressurization system to control the pressure of the collected samples, while the validation chamber may or may not have a gas charge system.

FIGS. 13A–D are schematic illustrations of the steps for sequentially filling a sample chamber, shutting in the sample chamber, using a separate gas charging chamber for extracting a portion of the sample from the sample chamber to the validation chamber, and shutting in both the sample and validation chambers. These figures illustrate but one of many possible arrangements of a gas charging module which functions as a pressurization system. This arrangement allows the validation sample to be displaced directly from the full sized sample chamber 110. The chambers in this arrangement can be inverted so that the sample comes in from the top instead of the bottom, although the orientation shown is preferred. These arrangements show schematically one embodiment of the associated flow lines, seal valves, and shut-off valves for controlling the pressure of a collected sample with a charge of compressed gas, such as Nitrogen. It is also known in the art to equip sample chamber 110 with a self shut-off mechanism which could reduce the amount of valves necessary to isolate the sample chambers from the flow line. There are also design concepts for multi-directional seal valves which could further reduce the number of valves needed.

Figures 13A, 13B, 13C, 13D:
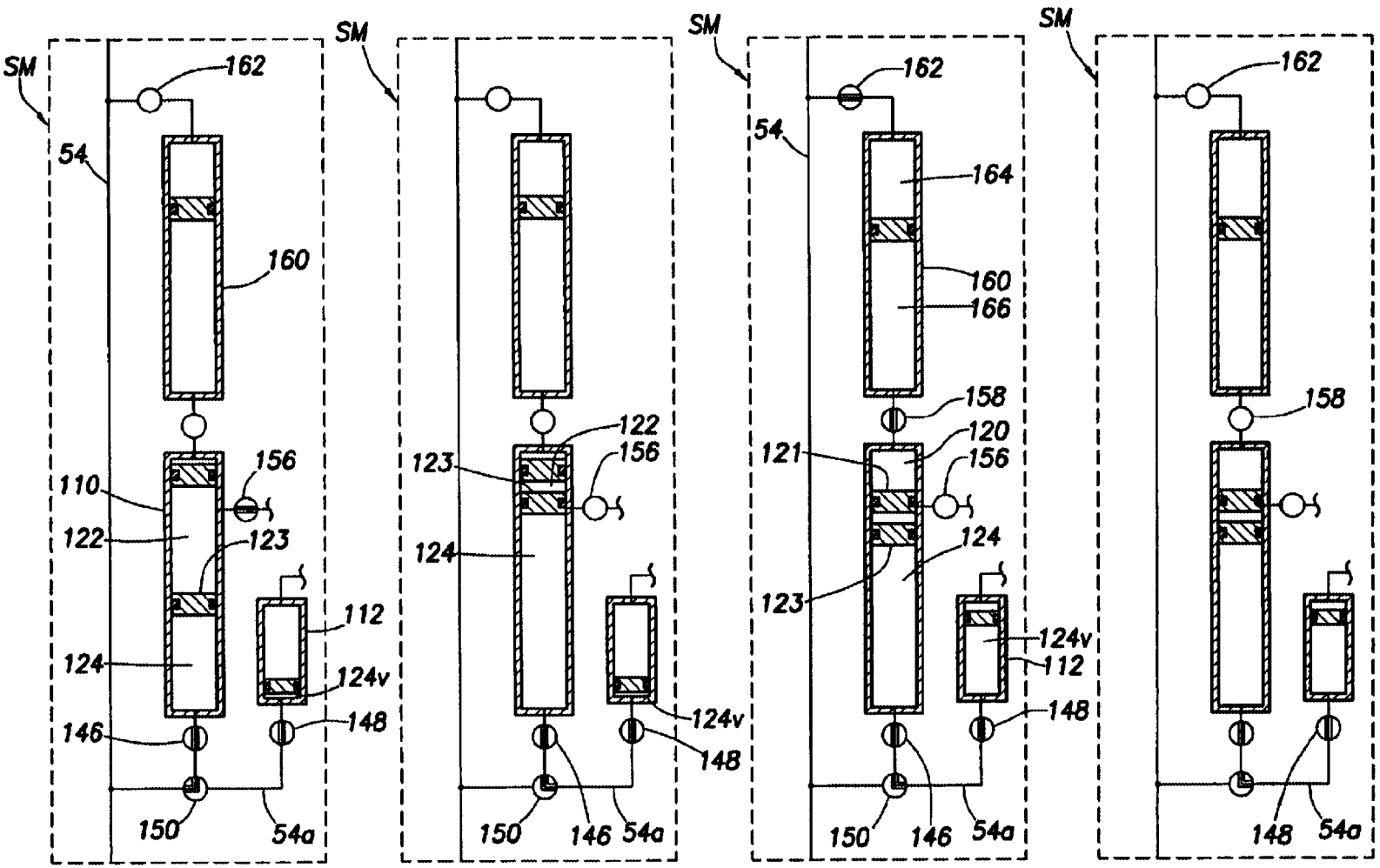

In FIG. 13A, formation fluid is flowing through flow line 54 past seal valve 150 and shut-off valve 146 into collection cavity 124. Valve 162 is closed at this time. In FIG. 13B, sample chamber 110 is filled, as seen by fully elevated piston 123, which becomes hydraulically stopped from further travel because the buffer fluid in cavity 122 can no longer escape through outlet valve 156. At this time, outlet valve 156 is closed, and seal valve 150 is closed to flow line 54 but opened to flow line 54*a*, interconnecting fluid collection cavities 124 and 124*v*. In FIG. 13C, valves 162 and 158 are opened, permitting the fluid pressure in flow line 54 to fill cavity 164 of gas charge chamber 160, forcing gas in chamber 166 through valve 158 into pressurization cavity 120. This has the effect of urging pistons 121 and 123 downwardly, forcing fluid in collection cavity 124 out through valves 146, 150, and 148 into collection cavity 124*v* of validation chamber 112. Then, in FIG. 13D, valves 162 and 158 are closed, shutting in the collected samples within chambers 110 and 112. Valve 148 may also be closed at this time as desired.

FIGS. 14A–D show another configuration of arranging sample chamber 110, validation chamber 112, and gas charging chamber 160, with the chambers being disposed in sample module SM and the gas charging chamber being disposed within gas charge module GM. In this configuration, both chambers 110 and 112 are pressure-controlled with a gas charge and are filled in parallel. It will be appreciated that this configuration can be expanded to include multiple full size chambers and/or validation sample chambers filling at the same time within sample module SM.

Figure 14A:
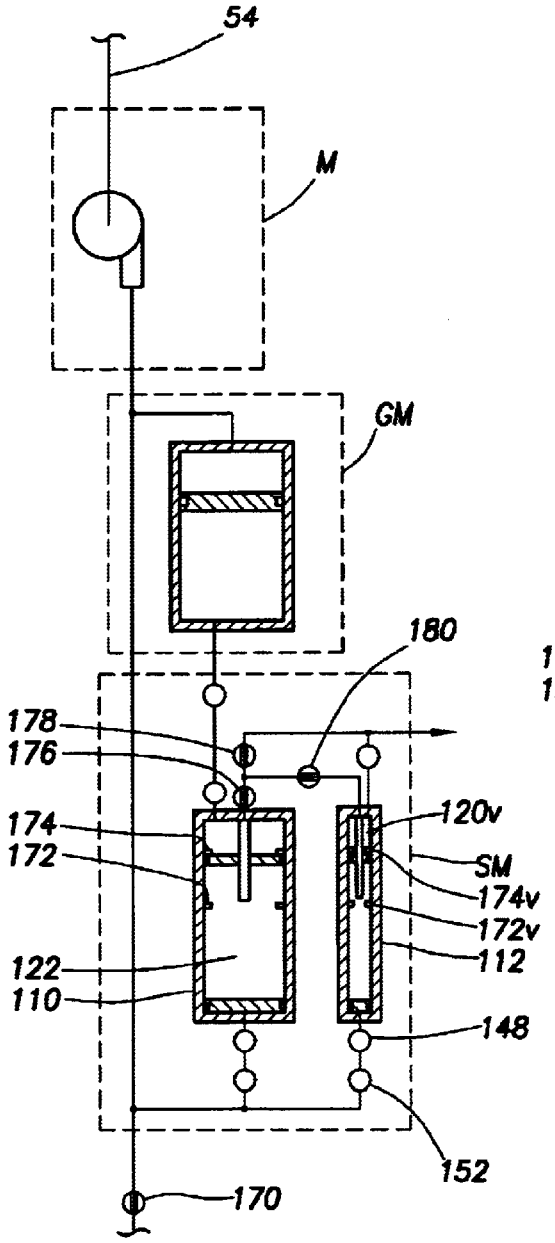

In FIG. 14A, pump-out module M (described above) pressurizes the formation fluid in flow line 54. The formation fluid is drawn from the formation using probe module E and/or F and is initially flushed through flow line 54 into the borehole via outlet valve 170. Buffer fluid present in cavities 122 and 122*v* is open to borehole pressure at this time by opening valves 176, 178, and 180, which urges pistons 121 and 121*v* to their uppermost position against stops 174 and 174*v*. In fact, borehole fluid may be used as the buffer fluid.

Figure 14B:
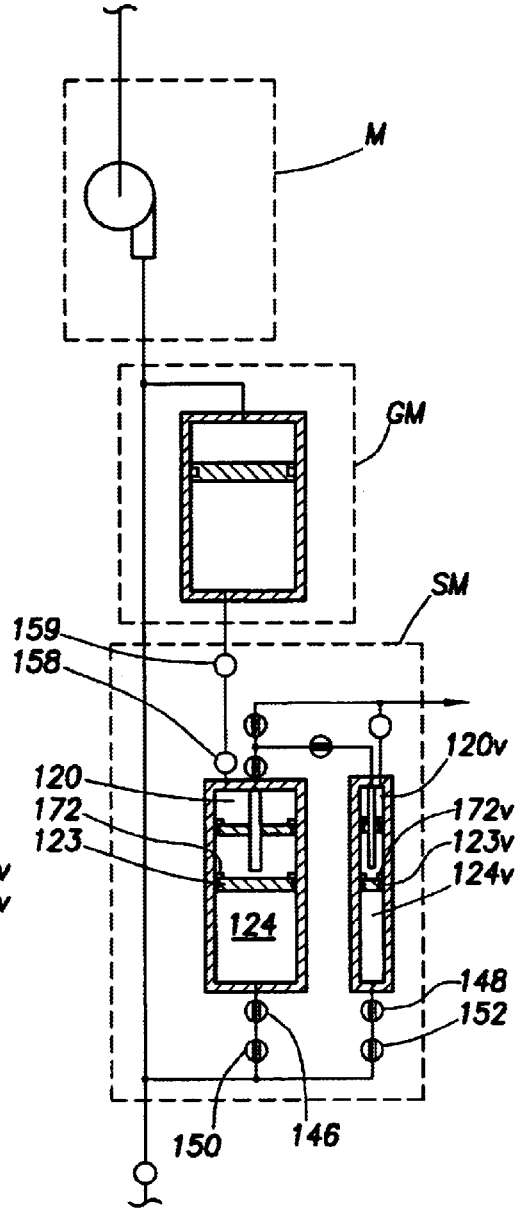

Referring now to FIG. 14B, once contaminants have been sufficiently flushed out of the fluid in flow line 54, outlet valve 170 is closed and fluid from flow line 54 is directed through seal valve 150 and shut-off valve 146 into collection cavity 124 of sample chamber 110. Similarly, fluid is also directed in parallel flow through seal valve 152 and shut-off valve 148 into collection cavity 124*v* of validation chamber 112. For this to occur, pump-out module M must overcome the wellbore pressure the acts on pistons 123 and 123*v*. Thus, the fluid in flow line 54 must be pumped to a pressure greater than wellbore pressure, which action causes the filling of collection cavities 124 and 124*v* and forces pistons 123 and 123*v* against respective stops 172 and 172*v*. This also expels portions of the buffer fluid present in cavities 122 and 122*v*. This is the Low Shock Sampling process, also described above.

Figure 14C:
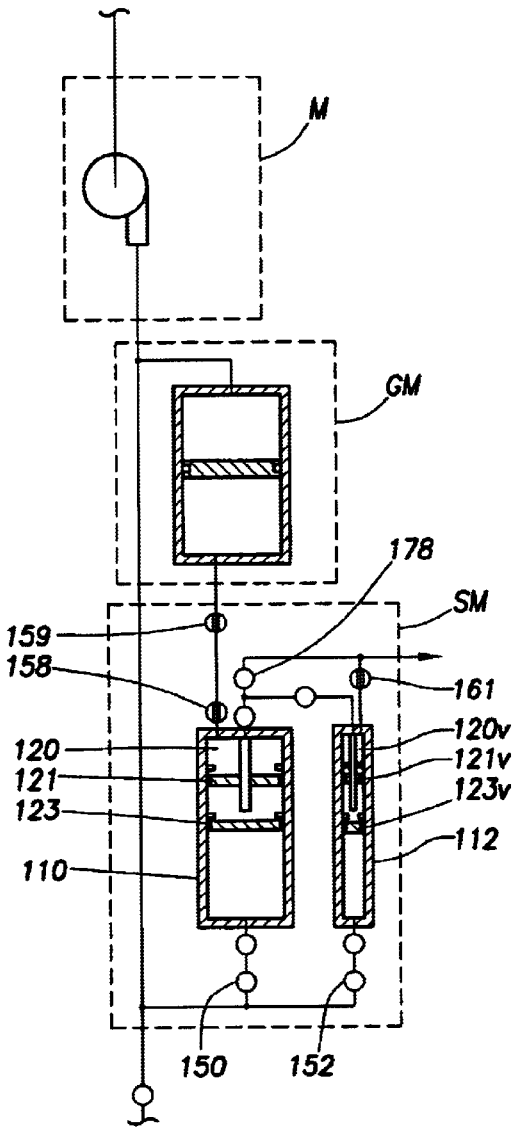

In FIG. 14C, the collected samples are shut in by closing seal valves 150, 152, and 178. Valves 158, 159, and 161 are opened, permitting fluid in flow line 54 to urge the piston in gas charging chamber 160 downwardly, charging cavities 120 and 120*v* with Nitrogen gas. This urges pistons 121, 123, 121*v*, and 123*v* downwardly to compress the samples collected in cavities 124 and 124*v*.

Figure 14D:
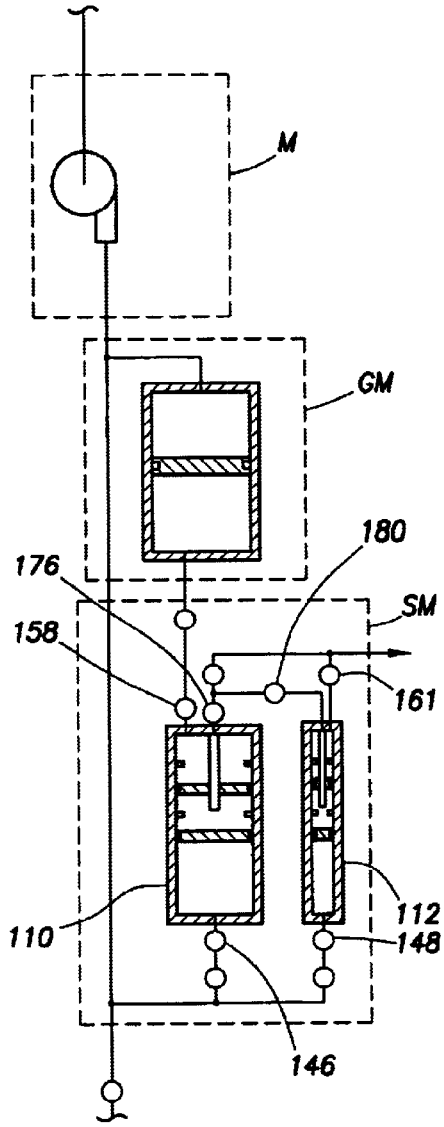

In FIG. 14D, the samples have been further compressed due to cooling of the sample as it comes to surface, as indicated by the additional downward movement of pistons 121, 123, 121*v*, and 123*v*. Valves 158, 176, 146, 148, 180 and 161 are closed manually after withdrawal. At some point prior to removal of chambers 110 and 112 from module SM, valve 159 must also be closed. Although valve 159 is shown as an electrically controlled seal valve, it may alternatively be a manual shut-off valve. The sample chambers are now at the surface, and the samples in cavities 124 and 124*v* have shrank from cooling during withdrawal from the wellbore. Gas in pressurization cavities 120 and 120*v* has expanded to maintain constant pressure the collected samples, keeping the samples in "single phase."

FIG. 15 is a schematic illustration of an alternative sample module SM incorporating gas charging chamber 160 that pressurizes buffer fluid 122, 122*v* in respective sample and validation chambers 110, 112 independently of fluid flow line 54 in the sample module.

It should be further noted that all of the sample chambers, PVT and validation, will have a mechanism which promotes agitation of the fluid in order to facilitate recombination of the sample components at the surface. This mechanism may be as simple as a solid slug or dense non-miscible liquid inside the sample chamber which will, when shaken or inverted, fall through the sample to promote mixing. This mechanism may also be a stirring mechanism attached to the chamber, or a magnetic stirring system. If an external system is developed which can agitate without contacting the sample, such as ultrasonic, the mechanism in the sample chamber may be left out of the design.

In view of the foregoing it is evident that the present invention is well adapted to attain all of the objects and features hereinabove set forth, together with other objects and features which are inherent in the apparatus disclosed herein.

Existing sampling tools do not satisfactorily address all of the issues involved in bringing a high quality reservoir sample to the surface. This new module will be superior to existing modules in this area. This module can be run in either open or cased holes with no dependence on the means of conveyance.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A sample module for use in a downhlole tool to obtain fluid from a subsurface formation penetrated by a wellbore, comprising:

a sample chamber carried by the module for collecting a sample of formation fluid obtained from the formation via the downhole tool; and a validation chamber carried by the module, the validation chamber being smaller than said sample chamber and capable of collecting a representative sample of the formation fluid collected by said sample chamber;

wherein said validation chamber is independently removable from the sample module and adapted for evaluation of said representative sample at the surface whereby the viability of the sample of formation fluid in said sample chamber is determined without disturbing said sample chamber.

2. The sample module of claim 1, wherein said sample chamber and said validation chamber are placed in parallel fluid communication with a sample fluid flowline in the downhole tool such that said chambers may be filled substantially simultaneously.

3. The sample module of claim 1, wherein said sample chamber and said validation chamber are placed in serial fluid communication with a sample fluid flowline in the downhole tool such that said chambers may be filled consecutively.

4. The sample module of claim 1, wherein said sample chamber is adapted for maintaining the sample stored therein in a single phase condition as the sample module is withdrawn with the downhole tool from the wellbore.

5. The sample module of claim 1, wherein said sample chamber and said validation chamber are adapted for maintaining the fluid samples stored therein in a single phase condition as the sample module is withdrawn with the downhole tool from the wellbore.

6. The sample module of claim 1, wherein said chambers are capable of safely withstanding heating at the surface, following collection of samples and withdrawal of the sample module from the wellbore, to temperatures necessary to promote recombination of the sample components within said chambers.

7. The sample module of claim 6, wherein each of said chambers includes metal-to-metal seals isolating the samples collected in said chambers, and means for bleeding excess pressure that develops in said chamber during heating.

8. The sample module of claim 1, wherein said sample chamber is sufficiently equipped so as to be certified for transportation.

9. The sample module of claim 8, wherein said sample chamber includes a sample collection cavity, the volume of which does not exceed 600 cc, and said sample chamber includes means for charging the sample collected within said sample chamber with a minimum gas cap of ten percent by volume.

10. The sample module of claim 1, wherein said sample chamber is adapted for storing the sample collected therein for an indefinite period without substantial degradation of the sample.

11. The sample module of claim 10, wherein said sample chamber includes metal-to-metal seals therein as final shut-off seals for isolating the sample collected therein.

12. A sample chamber for use in a downhole tool to obtain fluid from a subsurface formation penetrated by a wellbore, comprising:

a substantially cylindrical body capable of safely withstanding heating at the surface, following collection of a formation fluid sample via the downhole tool and withdrawal of the sample chamber from the wellbore, to temperatures necessary to promote recombination of the sample components within said chamber, said body being sufficiently equipped so as to be certified for transportation;

a floating piston slidably positioned within said body so as to define a fluid collection cavity and a pressurization cavity, whereby the pressurization cavity is charged with a minimum ten percent gas cap by volume to control the pressure of the sample collected in the collection cavity; and metal-to-metal seals extending through the cylindrical body that serve as final shut-off seals for the sample collected in the collection cavity of said body.

13. An apparatus for obtaining fluid from a subsurface formation penetrated by a wellbore, comprising:

a probe assembly for establishing fluid communication between the apparatus and the formation when the apparatus is positioned in the wellbore;

a pump assembly for drawing fluid from the formation into the apparatus;

a sample chamber for collecting a sample of the formation fluid drawn from the formation by said pumping assembly; and a validation chamber smaller than said sample chamber, said validation chamber being capable of collecting a representative sample of the formation fluid in said sample chamber, said validation chamber being independently removable from the apparatus at the surface for evaluation of said representative sample whereby the viability of the formation fluid collected in said sample chamber is determined at the wellbore without disturbing said sample chamber.

14. The apparatus of claim 13, wherein said sample chamber is adapted for maintaining the sample stored therein in a single phase condition as the apparatus is withdrawn from the wellbore.

15. The apparatus of claim 14, wherein said sample chamber includes a floating piston slidably positioned within said sample chamber so as to define a fluid collection cavity and a pressurization cavity, the apparatus further comprising:

a flow line establishing fluid communication between said probe assembly, said pump assembly, and the fluid collection cavity of said sample chamber; and a pressurization system for charging the pressurization cavity to control the pressure of the collected sample fluid within the collection cavity via the floating piston.

16. The apparatus of claim 15, wherein said pressurization system includes a valve positioned for fluid communication with the pressurization cavity of said sample chamber, the valve being movable between positions closing the pressurization cavity and opening the pressurization cavity to a source of fluid at a greater pressure than the pressure of the formation fluid delivered to the collection cavity.

17. The apparatus of claim 16, wherein said pressurization system controls the pressure of the collected sample fluid within the collection cavity during collection of the sample from the formation.

18. The apparatus of claim 17, wherein the source of fluid at a greater pressure than the pressure of the collected sample fluid is wellbore fluid.

19. The apparatus of claim 16, wherein said pressurization system controls the pressure of the collected sample fluid within the collection cavity during retrieval of the apparatus from the wellbore to the surface.

20. The apparatus of claim 19, wherein the source of fluid at a greater pressure than the pressure of the collected sample fluid is a source of inert gas carried by the apparatus.

21. The apparatus of claim 13, wherein the apparatus is a wireline-conveyed formation testing tool.

22. A method for obtaining fluid from a subsurface formation penetrated by a wellbore, comprising:

positioning an apparatus within the wellbore;

establishing fluid communication between the apparatus and the formation;

inducing movement of fluid from the formation into the apparatus;

delivering a sample of the formation fluid moved into the apparatus to a sample chamber for collection therein;

delivering a representative sample of the formation fluid moved into the sample chamber to a validation chamber for collection therein, the validation chamber being smaller than the sample chamber;

withdrawing the apparatus from the wellbore;

removing the validation chamber from the apparatus without disturbing the sample chamber; and evaluating the representative sample whereby the viability of the sample in the sample chamber is determined.

23. The method of claim 22, wherein the formation fluid samples are delivered to the sample chamber and the validation chamber substantially simultaneously.

24. The method of claim 22, wherein the formation fluid samples are delivered to the sample chamber and the validation chamber consecutively.

25. The method of claim 22, further comprising the step of maintaining the sample stored in the sample chamber in a single phase condition as the apparatus is withdrawn from the wellbore.

26. The method of claim 25, wherein the sample chamber includes a floating piston slidably positioned therein so as to define a fluid collection cavity and a pressurization cavity, and the sample of the formation fluid moved into the apparatus is delivered to the collection cavity, the method further comprising the step of charging the pressurization cavity to control the pressure of the sample delivered to the collection cavity.

27. The method of claim 26, wherein the pressurization cavity is charged to control the pressure of the sample fluid within the collection cavity during collection of the sample from the formation.

28. The method of claim 27, wherein the pressurization cavity is charged by wellbore fluid.

29. The method of claim 26, wherein the pressurization cavity is charged to control the pressure of the sample fluid collected within the collection cavity during retrieval of the apparatus from the wellbore to the surface.

30. The method of claim 29, wherein the pressurization cavity is charged by a source of inert gas.

31. The method of claim 22, further comprising the step of maintaining the samples stored in the validation chamber and the sample chamber in a single phase condition as the apparatus is withdrawn from the wellbore.

* * * * *